US008487172B1

(12) United States Patent
Burgett et al.

(10) Patent No.: US 8,487,172 B1
(45) Date of Patent: Jul. 16, 2013

(54) PIANO ACTION FLANGE WITH OPEN-SLOTTED RAIL ATTACHMENT FEATURE

(75) Inventors: Kirk Burgett, Sacramento, CA (US); Jamie Marks, Haverhill, MA (US); Dana Mazzaglia, Haverhill, MA (US)

(73) Assignee: Wessell, Nickel & Gross, Sacramento, CA (US)

( * ) Notice: Subject to any disclaimer, the term of this patent is extended or adjusted under 35 U.S.C. 154(b) by 0 days.

(21) Appl. No.: 13/354,245

(22) Filed: Jan. 19, 2012

(51) Int. Cl.
*G10C 3/18* (2006.01)

(52) U.S. Cl.
USPC ..... 84/451; 84/240; 84/236; 84/239; 84/243

(58) Field of Classification Search
USPC ..... 84/251, 240, 236, 239, 243
See application file for complete search history.

(56) References Cited

U.S. PATENT DOCUMENTS

| | | | | | |
|---|---|---|---|---|---|
| 173,377 | A * | 2/1876 | Waite | ..... | 84/240 |
| 519,166 | A * | 5/1894 | Wallace | ..... | 84/240 |
| 1,010,778 | A * | 12/1911 | Mayor | ..... | 84/251 |
| 1,353,905 | A * | 9/1920 | Gertz | ..... | 84/251 |
| 1,748,777 | A * | 2/1930 | Laukandt | ..... | 84/240 |
| 2,146,114 | A * | 2/1939 | Finholm | ..... | 84/240 |
| 2,247,998 | A * | 7/1941 | Healey | ..... | 84/240 |
| 2,260,287 | A * | 10/1941 | Betz | ..... | 84/240 |
| 2,501,529 | A * | 3/1950 | Markley | ..... | 84/240 |
| 2,580,436 | A * | 1/1952 | Knoblaugh | ..... | 384/298 |
| 2,580,437 | A * | 1/1952 | Knoblaugh | ..... | 384/298 |
| 3,228,277 | A * | 1/1966 | Roehrig | ..... | 84/240 |
| 3,696,699 | A * | 10/1972 | Tachida | ..... | 84/251 |
| 5,299,484 | A * | 4/1994 | Ishida et al. | ..... | 84/251 |
| 6,232,537 | B1 * | 5/2001 | Kimble | ..... | 84/216 |
| 8,143,506 | B2 * | 3/2012 | Clark et al. | ..... | 84/236 |

* cited by examiner

*Primary Examiner* — David Warren
*Assistant Examiner* — Robert W Horn
(74) *Attorney, Agent, or Firm* — Craig A. Simmermon

(57) ABSTRACT

A piano action flange with an open-slotted rail attachment feature that is a slot-shaped void completely through the piano action flange, running in the longitudinal direction of the piano action flange, with width slightly larger than the outer diameter of the thread end the flange screw but smaller that the head diameter of the flange screw, where the slot-shaped void is open on one end, breaking through the end of said piano action flange, to leave the slot-shaped void open and accessible from the end of the piano action flange.

1 Claim, 7 Drawing Sheets

Prior Art

PIANO ACTION FLANGE WITH OPEN-SLOTTED RAIL ATTACHMENT FEATURE

BACKGROUND OF THE INVENTION

1. Field of the Invention

This invention relates to piano actions, or more specifically the mechanisms in pianos that transmit motion from a piano player's fingers into motion of a hammer, located inside the piano, causing the hammer to strike a piano string, thereby producing sound or music from the piano. A piano action is a complicated assembly of smaller mechanical components. In every piano, there is a separate piano action and hammer corresponding to each piano key, where there are typically 88 keys in a piano.

Piano actions are an assembly of smaller mechanical components that transmit motion from a piano key to a hammer, where this is accomplished, in part, by the rotational motion of the action's smaller mechanical components or subcomponents. Rotating subcomponents include: the hammer butt, the whippen, and the damper lever. Rotational motion requires a fixed center-of-rotation point. Thus, each of the subcomponents listed above have a fixed center-of-rotation point. Mechanically, these centers-of-rotation are created with flanges that are securely affixed to stationary rails in the piano, where the centers-of-rotation are center pins or hinge pins located in the flanges to form a hinge member. Thus, each hammer butt, whippen, and damper lever in a piano action rotates around a center pin or hinge pin, held steady by a flange that is affixed to a stationary rail inside the piano. This invention relates to these three flanges of a piano action: the hammer butt flange, the whippen flange, and the damper flange.

2. Description of Related Art

A center pin or hinge pin in an action flange is a pivot point for the rotating subcomponents of the piano action. A piano action flange is a rigid flat oblong-shaped article, with a hinge on one end and a mounting hole or screw hole on the other end. Said hinge comprises one or two hinge pin holes, where a center pin or hinge pin is installed. Said hinge pin holes are positioned to run perpendicular to the longitudinal axis of the action flange and parallel to the top surface of the action flange. In the case of a flange with one hinge pin hole, the hinge pin hole is located on the center of the flange, where the hinge pin hole would mate with two other hinge pin holes on the action component, to mesh and align with each other, so that the hinge pin may be installed into all three hinge pin holes, the one on the flange and the two on the action part, to create a hinge member pivotally connecting the flange to the action part. In the case of a flange with two hinge pin holes, the two hinge pin holes would mate with an action component with one hinge pin hole, to stratal and align with the hinge pin hole on the action component, so that the hinge pin may be installed into all three hinge pin holes, the two on the flange and the one on the action part, to create a hinge member pivotally connecting the flange to the action part.

At the other end of a piano action flange, there is one mounting hole or screw hole that runs completely through the flange, perpendicular to the hinge pin. The mounting hole is used to mount the flange to the stationary rail in the piano. This is accomplished by screw means, placing a flange screw through the mounting hole and threading the flange screw into a tapped hole located in the rail to affix the flange to the rail. With this design, the flange screw must be completely removed in order to remove the flange and or the action subcomponent that the flange is hinged to. Periodic removal of these items is required for proper maintenance and care of the piano.

This invention does not teach the use of a mounting hole in a piano action flange. This invention teaches the use of a "slot that is open on one end" to secure all flanges to the rail. With this design, flanges and action subcomponents may be removed, replaced, and maintained without the former requirement of completely removing the flange screw in order to remove a flange or the action part hinged to the flange.

BRIEF SUMMARY OF THE INVENTION

It is an aspect of this invention to provide a hammer butt flange for a grand piano with an open-slotted rail attachment feature to allow the ability to remove and re-install the hammer butt flange from the tapped hole in the main action rail without completely removing the flange screw from the tapped hole in the main action rail.

It is an aspect of this invention to provide a hammer butt flange for an upright piano with an open-slotted rail attachment feature to allow the ability to remove and re-install the hammer butt flange from the main action rail without completely removing the flange screw from the tapped hole in the main action rail.

It is an aspect of this invention to provide a whippen flange for a grand piano with an open-slotted rail attachment feature to allow the ability to remove and re-install the hammer butt flange from the tapped hole in the whippen rail without completely removing the flange screw from the whippen rail.

It is an aspect of this invention to provide a whippen flange for an upright piano with an open-slotted rail attachment feature to allow the ability to remove and re-install the whippen flange from the main action rail without completely removing the flange screw from the tapped hole in the main action rail.

It is an aspect of this invention to provide a damper flange for a grand piano with an open-slotted rail attachment feature to allow the ability to remove and re-install the damper flange from the tapped hole in the damper lift rail without completely removing the flange screw from the damper lift rail.

It is an aspect of this invention to provide a damper flange for an upright piano with an open-slotted rail attachment feature to allow the ability to remove and re-install the damper flange from the main action rail without completely removing the flange screw from the tapped hole in the main action rail.

It is an aspect of open-slotted rail attachment feature of this invention that the width of said open-slot is greater than the overall diameter of the thread end of a piano flange screw but less the head diameter of a piano flange screw, where the typical prior art flange screws are used for this sizing.

DEFINITION LIST

| Term | Definition |
|---|---|
| 1 | Hammer |
| 2 | Hammer Shank |
| 3 | Hammer Butt |
| 4 | Center Pin or Hinge Pin |
| 5 | Prior Art Hammer Butt Flange |
| 6 | Mounting Hole or Screw Hole |
| 7 | Hammer Shank |
| 8 | Hammer Butt |
| 9 | Center Pin or Hinge Pin |
| 10 | Hammer Butt Flange with Open-Slotted Rail Attachment Feature |
| 11 | Open-Slotted Rail Attachment Feature |
| 12 | Action Rail |
| 13 | Flange Screw |
| 14 | Jack |
| 15 | Action Rail |
| 16 | Flange Screw "tightened" |
| 17 | Jack |
| 18 | Hammer Butt Flange with Open-Slotted Rail Attachment Feature |
| 19 | Action Rail |
| 20 | Flange Screw "loosened" but not removed |
| 21 | Jack |

DETAILED DESCRIPTION OF THE INVENTION

Both grand piano actions and upright piano actions have smaller subcomponents that must rotate in order for the piano action to cycle properly. Among these rotating subcomponents are: the hammer butt, the whippen (otherwise known as the repetition base), and the damper lever. Both grand piano actions and upright piano actions include these three rotating subcomponents.

In order for the actions to cycle properly, the hammer butt, the whippen, and the damper lever must each be attached or affixed to a stationary rail in the piano. Piano rails may be made of wood or metal. Flanges are used to attach the hammer butt, the whippen, and the damper lever to the rails. One flange is used for each hammer butt, whippen, and damper lever. There are typically 88 hammer butts, 88 whippens, and 88 damper levers in each piano. Therefore, each piano requires 264 flanges to properly attach the hammer butts, the whippens, and the damper levers to the stationary rails.

Figure 1:
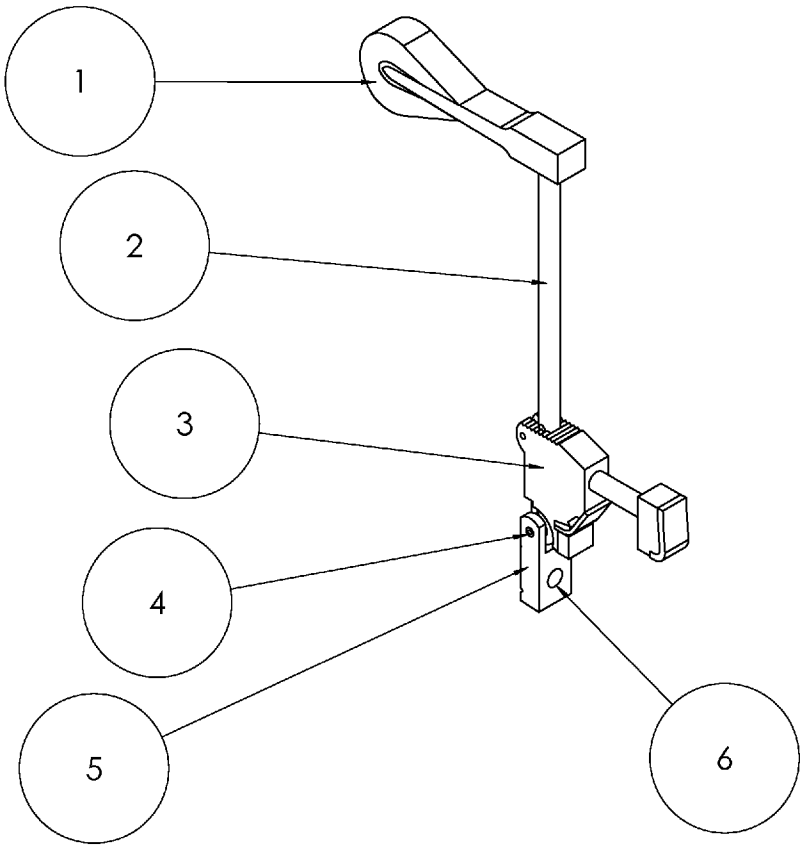
FIG. 1 is front perspective view of a prior art hammer assembly of a piano action.
Figure 2:
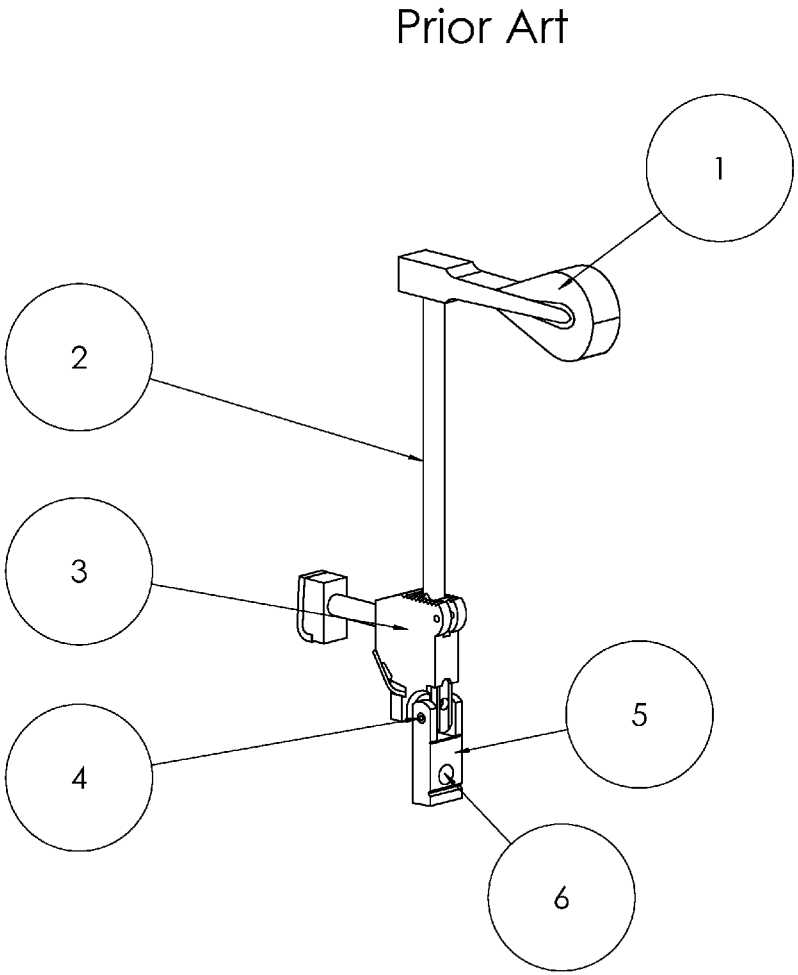
FIG. 2 is a back perspective view of a prior art hammer assembly of a piano action.
Figure 3:
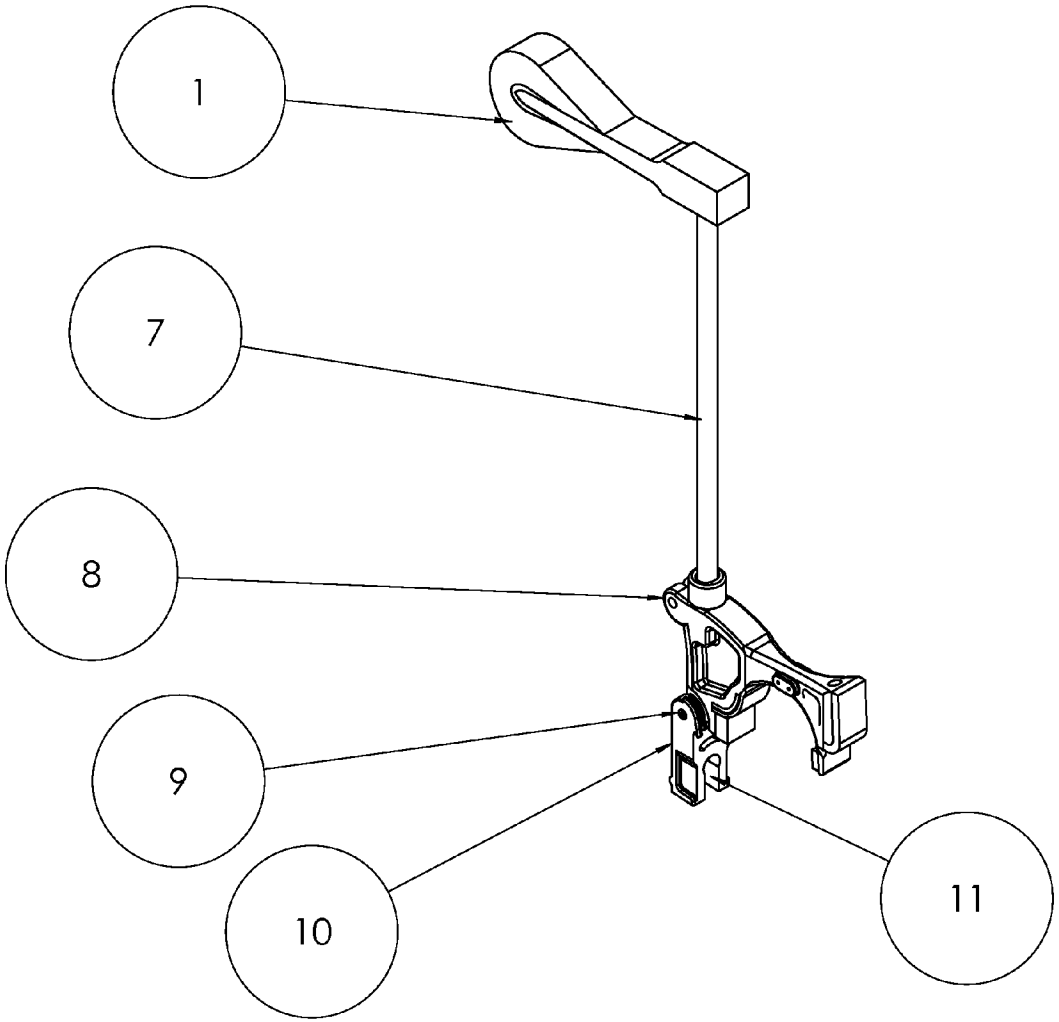
FIG. 3 is a front perspective view of a hammer assembly with hammer butt flange with open-slotted rail attachment feature.
Figure 4:
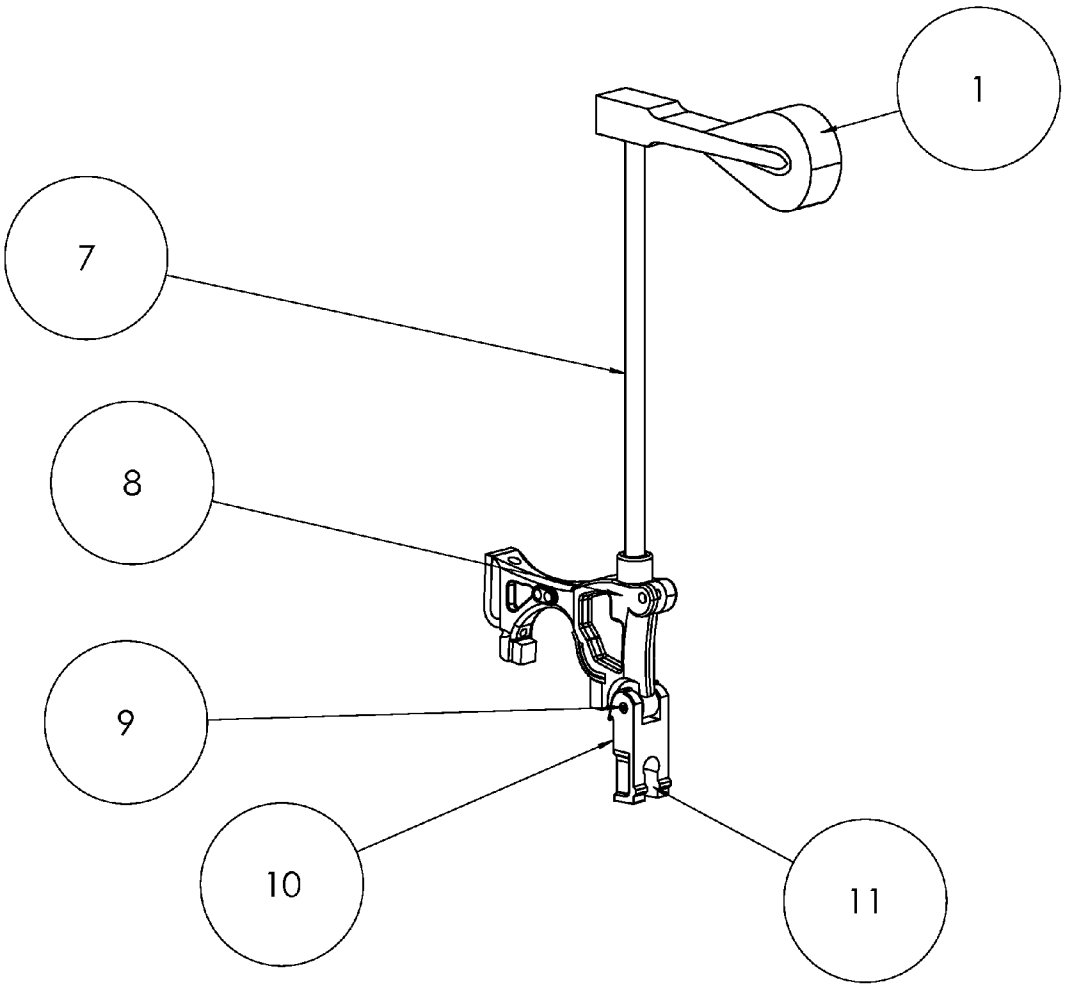
FIG. 4 is a back perspective view of a hammer assembly with hammer butt flange with open-slotted rail attachment feature.

FIGS. 1 and 2 depict a prior art hammer assembly comprising: a hammer 1, a hammer shank 2, a hammer butt 3, a hinge pin 4, and a hammer butt flange 5. During cycling of the action, the hammer butt 3 is rotated, thereby causing rotation of the hammer 1 into the piano strings (not depicted) in order to produce piano sound. In order for proper cycling, the hammer butt flange 5 must be affixed to a stationary rail. In the prior art, this affixation has always been accomplished using a screw hole 6. Screw hole 6 is simply a drilled or bored hole through hammer butt flange 5, through which a flange screw is placed, and then threaded into a tapped hole located on the rail in order to affix flange 5 to the rail.

Figure 5:
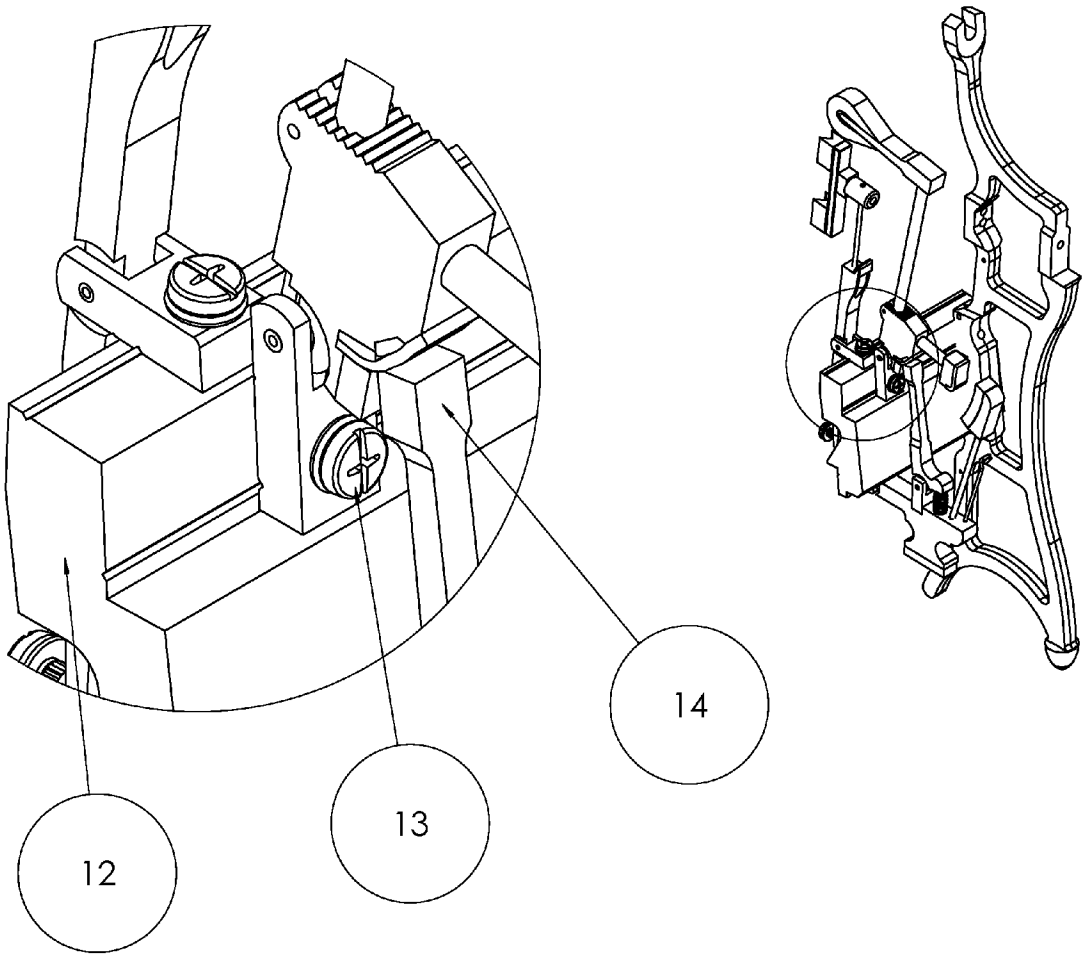
FIG. 5 is a front perspective view of a prior art hammer assembly and a prior art damper assembly installed and affixed to the piano's action rail, along with a blow-up view of a prior art hammer butt flange and a prior art damper flange installed and affixed to the piano's action rail.

FIG. 5 depicts a blow-up view of a prior art hammer butt flange attached to action rail 12 by the prior art means using a screw hole, where a flange screw 13 is tightened onto a tapped hole in action rail 12. Also depicted is a blow-up view of a prior art damper flange attached to action rail 12 by the prior art means using a screw hole, where a flange screw is tightened onto a tapped hole in action rail 12. Prior art whippen flanges (not depicted) also utilize one screw hole 6 in order to mount the whippen flange to the stationary rail. Thus, all three prior art flanges, the hammer butt flange, the damper flange, and the whippen flange use the one screw hole method to attach to a stationary rail in the piano. Note that with the prior art, the flange screws must be completely removed from the tapped hole in the rail in order to remove the hammer butt flange, the damper flange, or the whippen flange from the piano.

This is not the case with the piano action flanges of this invention because these flanges include an open-slotted rail attachment feature 11. Piano action flange with open-slotted rail feature is a rigid flat oblong-shaped article, with a hinge on one end and an open-slotted rail attachment feature 11 on the other end.

Said hinge on piano action flange with open-slotted rail attachment feature comprises: one or two hinge pin holes, into which a center pin or hinge pin 9 may be installed. Hammer butt flange with open-slotted rail attachment feature 10 has hinge end with two hinge pin holes. Said hinge pin holes are positioned to run perpendicular to the longitudinal axis of the action flange and parallel to the top surface of the action flange. In the case of an action flange with one hinge pin hole (not depicted), the hinge pin hole is located on the center of the flange, where the hinge pin hole would mate with two other hinge pin holes on the action component, to mesh and align with each other, so that the hinge pin may be installed into all three hinge pin holes, the one on the flange and the two on the action part, to create a hinge member pivotally connecting the flange to the action part. In the case of an action flange with two hinge pin holes (as depicted in the figures), the two hinge pin holes would stratal and mate with one hinge pin hole on the action component, to mesh and align with the hinge pin hole on the action component, so that the hinge pin may be installed into all three pin holes, the two on the flange and the one on the action part, to create a hinge member pivotally connecting the flange to the action part. Thus, there is a mode of action flange with open-slotted rail attachment feature with one hinge pin hole and a mode of action flange with open-slotted rail attachment feature with two hinge pin holes.

At the other end of piano action flange with open-slotted rail attachment feature, there is a slot that is open on one end 11. Slot open on one end 11 is a slot-shaped void running all the way through the flange, where the slot is open on one end, where the slot breaks through the end of the flange, to leave the slot open and accessible from the end of the flange. Slot open on one end 11 runs in the longitudinal direction of the flange. Slot open on one end 11 has width that slightly larger than the outer diameter of the thread end of flange screw 13, 16, and 19, but smaller that the head diameter of flange screw 13, 16, and 19.

Figure 6:
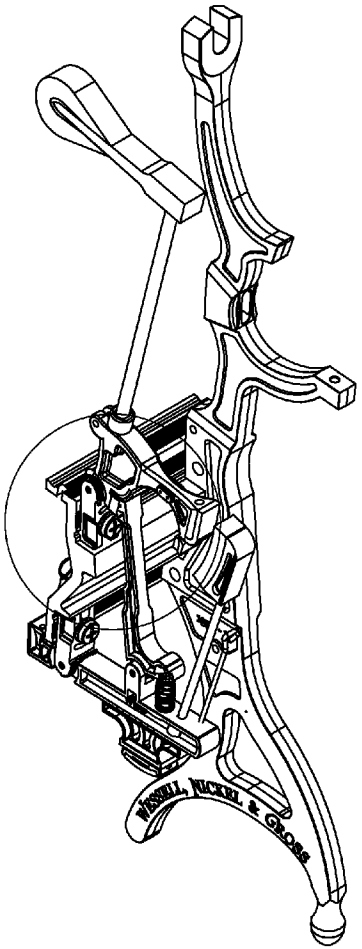
FIG. 6 is a front perspective view of a hammer assembly with hammer butt flange with open-slotted rail attachment feature installed and affixed to the piano's action rail, along with a blow-up view thereof.
Figure 6:
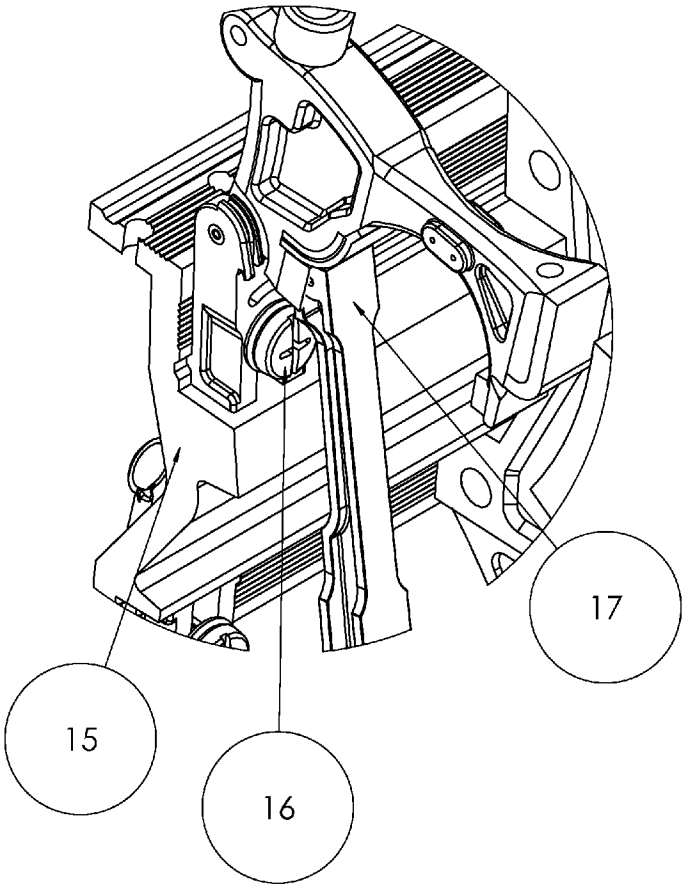

FIG. 6 depicts hammer butt flange with open-slotted rail attachment feature 10 attached to or affixed to action rail 15. With flange screw 16 tightened onto slot that is open on one end 11, the head of flange screw 16 tightly clamps down onto the hammer butt flange 10 to securely affix it to action rail 15.

Figure 7:
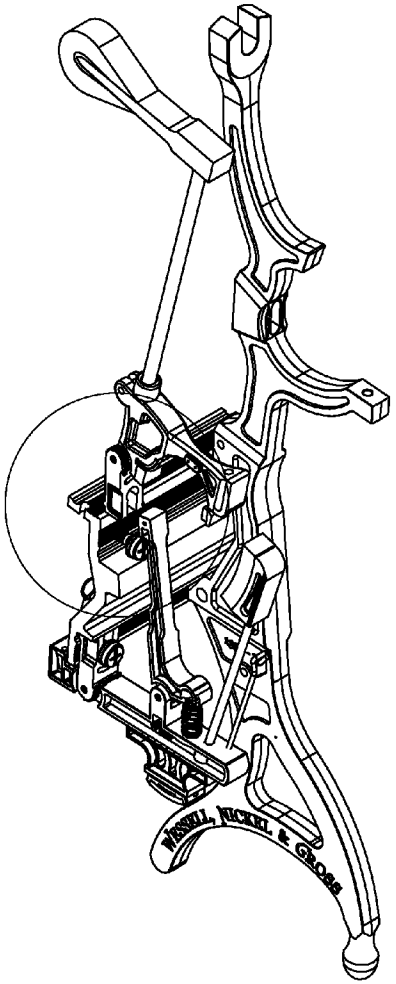
FIG. 7 is a front perspective view of a hammer assembly with hammer butt flange with open-slotted rail attachment feature, just after removal from the piano's action rail, along with a blow-up view thereof.
Figure 7:
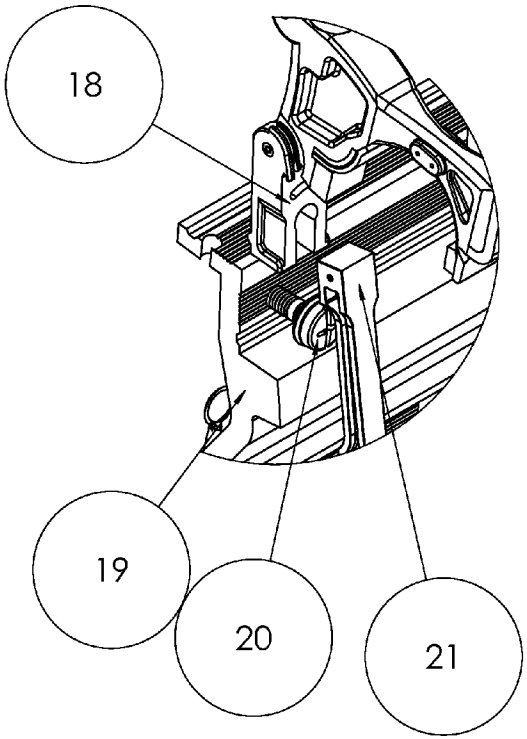

FIG. 7 depicts hammer butt flange with open-slotted rail attachment feature 10 just after hammer butt flange 18 has been removed from action rail 19. In this case, flange screw 20 has been loosened but not removed from the tapped hole in rail 19. Flange screw 20 has been loosened enough so that the head of the screw no longer clamps down on the hammer butt flange 18 so that hammer butt flange 18 may be slid off of the flange screw 20. At this point, the piano technician may repair or replace the necessary components and then quickly re-install the actions parts onto action rail 19 without removing and reinstalling flange screw 20.

Open-slotted rail attachment feature 11 is the same size and design for each of the action flanges: hammer butt flange 10, whippen flange (not depicted), and damper flange (depicted, not labelled). Thus, the open-slotted rail attachment feature 11 opposite the hinge end is the same for the hammer butt flange 10, the whippen flange, and the damper flange of this invention.

As stated above the hinge end piano action flange with open-slotted rail attachment feature varies with either one pin hole or two pin holes in order to properly mate with the design of respective action part to which it is hinged.

What is claimed:

1. A piano action flange comprising: a hinge end and an open-slotted rail attachment feature, wherein, said piano action flange is a rigid flat oblong-shaped article, said hinge end has one or two hinge pin attachment holes capable of mating with the corresponding hinge pin attachment holes of a hammer butt, a whippen, or a damper of a grand piano action or the corresponding hinge pin attachment holes of a hammer butt, a whippen, or a damper of an upright piano, and said open-ended rail attachment feature is a slot-shaped void completely through said piano action flange, running in the longitudinal direction of said piano action flange, with width slightly larger than the outer diameter of the thread end the flange screw but smaller that the head diameter of the flange screw, where the slot-shaped void is open on one end, breaking through the end of said piano action flange, to leave the slot-shaped void open and accessible from the end of said piano action flange.

* * * * *